United States Patent [19]

Seko et al.

[11] 3,977,778

[45] Aug. 31, 1976

[54] ELECTROPHOTOGRAPHIC APPARATUS

[75] Inventors: Nachio Seko, Sagamihara; Hiroshi Hirose, Machida, both of Japan

[73] Assignee: Ricoh Co., Ltd., Tokyo, Japan

[22] Filed: July 3, 1974

[21] Appl. No.: 485,751

[30] Foreign Application Priority Data

July 6, 1973 Japan ..... 48-75652

[52] U.S. Cl. ..... 355/3 R; 355/68; 355/69

[51] Int. Cl.[2] ..... G03G 15/26

[58] Field of Search ..... 355/3 R, 3 DD, 68, 69, 355/17, 11, 14, 35–38; 354/22, 23; 356/201, 202, 209; 118/637, 620, 621; 117/17.5; 96/1 C; 317/262 A

[56] References Cited

UNITED STATES PATENTS

| | | | |
|---|---|---|---|
| 2,551,582 | 5/1951 | Carlson | 355/16 UX |
| 2,890,968 | 6/1959 | Giaimo | 355/4 X |
| 3,249,000 | 5/1966 | Pack | 355/68 |
| 3,522,991 | 8/1970 | Bowen | 355/68 X |
| 3,704,947 | 12/1972 | Reimann | 355/69 X |
| 3,877,803 | 4/1975 | Seliger | 355/69 X |

*Primary Examiner*—L. T. Hix
*Assistant Examiner*—Kenneth C. Hutchison
*Attorney, Agent, or Firm*—Cooper, Dunham, Clark, Griffin & Moran

[57] ABSTRACT

In electrophotographic apparatus for producing positive copies of both positive and negative originals with toner of one polarity by establishing and developing an electrostatic latent image on a light-sensitive member that is precharged to a first polarity for positive originals and to the opposite polarity for negative originals, wherein means are provided for exposing the precharged member to an optical image of the original and for controlling the exposure by varying the amount of light used, a two-position changeover switch for reversing the operation of the exposure controller depending on whether the original is positive or negative. This changeover switch, and also a switch for reversing the charging polarity of means for precharging the light-sensitive member, may be controlled by photoelectric means for determining whether the original is positive or negative by sensing the optical density of a marginal portion provided on the original.

8 Claims, 5 Drawing Figures

ELECTROPHOTOGRAPHIC APPARATUS

BACKGROUND OF THE INVENTION

The invention relates to an electrophotographic apparatus in which the image of an original is projected through an exposure controller onto a light-sensitive member which is previously uniformly charged, to form an electrostatic latent image thereon, and more particularly to such apparatus in which a positive copy image is obtained for either a negative or positive original by using a toner of a fixed polarity as a developer and by switching the polarity with which the light-sensitive member is charged.

In a copying apparatus of the type described, when it is desired to adjust the optical density of the copy, the dial on the exposure controller is turned to change the amount of light emitted by the exposure lamp. However, the direction of such adjustment is reversely related depending on whether the original is a negative or a positive image. Specifically, for a negative original, the amount of light from the lamp is increased in order to obtain an increased optical density while the light quantity is decreased for a reduced density. The reverse is true with a positive original. Thus, in the case of a positive original, the light quantity must be increased to provide a reduced optical density while an increased optical density is achieved with a reduced light quantity. As a result, the dial on the exposure controller must be turned in the opposite direction for a positive image from the direction in which it is turned for a negative image. This is inconvenient in practical operations, and often causes malfunctioning.

SUMMARY OF THE INVENTION

It is an object of the invention to eliminate the foregoing disadvantages of copying apparatus of the type described above.

In accordance with the invention, the above object is accomplished by providing a change-over switch in the exposure controller, which switch is changed depending on whether the original is a positive or a negative image. A particularly advantageous electrophotographic apparatus can be obtained by the provision of a photoelectric detector sensitive to a variation in the optical density in the marginal edge of the original for discriminating between a negative and a positive image, and switching means adapted for interlocked operation with the change-over switch in the exposure controller and responsive to a detection signal from the detector to change the polarity of the charger.

Other features and advantages of the invention will become apparent from the following description of an embodiment of the invention shown in the attached drawings.

DETAILED DESCRIPTION

Figure 1:
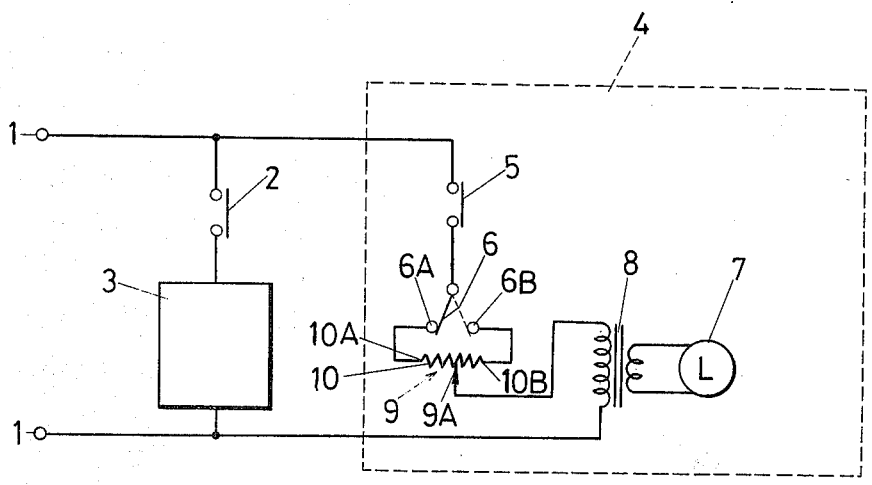
FIG. 1 is a schematic illustration of the exposure controller circuit used in the invention.

Referring to FIG. 1, there are shown a pair of terminals 1, 1 across which a power supply (not shown) is connected. A pair of branch circuits are connected across the supply terminals, one including a print start switch 2 in series with a print drive circuit 3 and the other being an exposure controller circuit 4. The circuit 4 includes a pair of contacts 5 of an exposure timer, a change-over switch 6 having its movable arm connected with one of the contacts 5 and having a pair of change-over contacts 6A, 6B across which an exposure controller 9 formed by a potentiometer 10 is connected, and a transformer 8 having its primary connected with a movable tap on the potentiometer, all of these elements being connected in series across the supply terminals 1, 1. The circuit 4 further includes an exposure lamp 7 which is connected across the secondary of the transformer 8. The potentiometer 10 serves to adjust the primary voltage on the transformer 8 and thereby to control the amount of light emitted by the lamp 7.

The change-over switch 6 is thrown to either contact 6A or contact 6B depending on whether the original is a negative or a positive image. In the example shown, it is assumed that the change-over switch 6 is thrown to the contact 6A as shown in solid line when the original is a negative image. In this instance, the primary voltage of the transformer 8, and consequently the amount of light emitted by the exposure lamp 7 is at its maximum when the movable tap 9A of the controller 9 is located on the end 10A of the potentiometer 10, and is at its minimum when the tap 9A is located on the end 10B of the potentiometer. Thus the optical density on the copy can be decreased by moving the movable tap 9A from the end 10A toward the end 10B of the potentiometer 10.

When the original is a positive image, the single pole, double throw changeover switch 6 is thrown to the contact 6B, as indicated in broken lines in FIG. 1. The amount of light from the exposure lamp 7 is now at its maximum when the movable tap 9A is located on the end 10B of the potentiometer 10 and is at its minimum when the tap 9A is located on the end 10A, thus reversing the effect of a given direction of adjustment of the potentiometer 10 of the controller 9. As mentioned previously, when it is desired to obtain a positive copy from a positive original, the optical density of the copy increases as the amount of light from the lamp is reduced. Consequently, in order to reduce the optical density of the copy, the movable tap 9A may be moved from the end 10A toward the end 10B of the potentiometer 10. It will be noted that this direction of movement of the movable tap is the same as that employed (to decrease the optical density of the copy) when the original is a negative image. In other words, the direction in which the dial of the controller (connected with the movable tap 9A) is moved to produce a desired optical density remains the same for both the positive and negative image, thus eliminating the possibility of an inadvertent operation. The direction of controller adjustment remains the same for both positive and negative images because the effect of a given direction of controller adjustment is selectably reversed by change-over switch 6, depending on whether the original is a positive or negative original.

Figure 2:
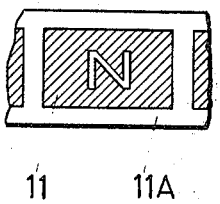
FIG. 2 is a plan view of a film carrying a negative original.
Figure 3:
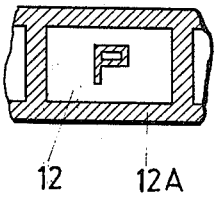
FIG. 3 is a plan view of a film carrying a positive original.

An embodiment of the invention as applied to an apparatus for automatically switching the polarity of charging in a microreader-printer will be described below with reference to FIGS. 2 to 5. FIG. 2 shows a film 11 carrying a negative original while FIG. 3 shows a film 12 carrying a positive original. The optical density in the marginal regions 11A, 12A of the respective films is established such that the marginal region 11A has a reduced density while the marginal region 12A has an increased density. In the apparatus of the invention, a photoelectric element determines the transmissive or reflective light quantity of such regions by comparison, thereby enabling switching of the polarity of charging to be performed automatically. The photoelectric element may be located at any desired position.

Figure 4:
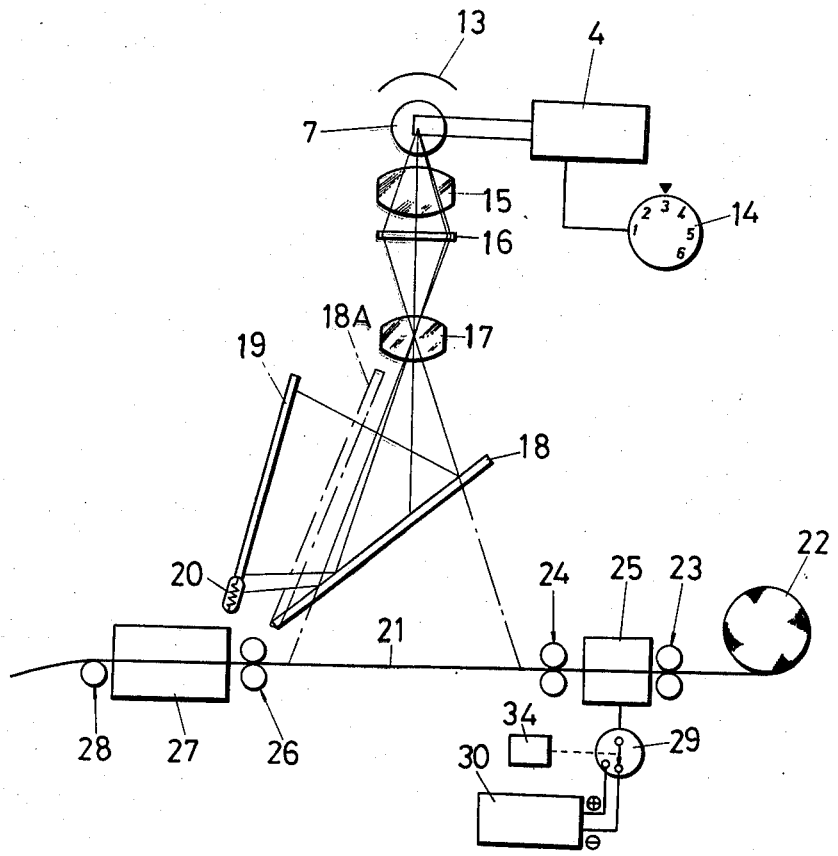
FIG. 4 is a schematic view of a microreader-printer in which the invention is incorporated.

FIG. 4 shows a microreader-printer in which light emitted by the exposure lamp 7 associated with a back reflecting mirror 13 passes through a condenser 15 and a microfilm 16 and is focused by a projection lens 17 onto a screen 19 through a reflecting mirror 18 interposed therebetween. The microfilm 16 may comprise either film 11 or film 12. The arrangement is such that the effective image area of the microfilm 16 is projected onto the screen 19 while the light which is transmitted through the remainder or the marginal region of the film is projected outside the screen 19 with a portion of such light impinging on a photoelectric element 20 disposed at the lower end of the screen 19.

When a copy is to be obtained, the reflecting mirror 18 is moved to the position indicated by phantom lines 18A so as to be disposed out of the path of light, thus allowing the light projected by the lens 17 to impinge on a light-sensitive paper 21 disposed directly below it. The light-sensitive paper 21 is reeled off a roll 22 and fed by pairs of feed rollers 23 and 24, the paper being charged by a charger 25 before it is fed into the exposure station shown. Subsequent to the exposure, the paper 21 is fed by a pair of feed rollers 26 into a developing unit 27, and the developed paper 21 is discharged externally by a pair of feed rollers 28. It will be appreciated that the light sensitive paper 21 is cut to size at a suitable stage in the process.

The charger 25 is connected through a high tension switch 29 with a high voltage generator 30. The polarity of the voltage supplied is switched as will be described hereinafter. The amount of light supplied by the exposure lamp 7 is controlled by the exposure controller 4 which is in turn operated by the exposure dial 14.

Figure 5:
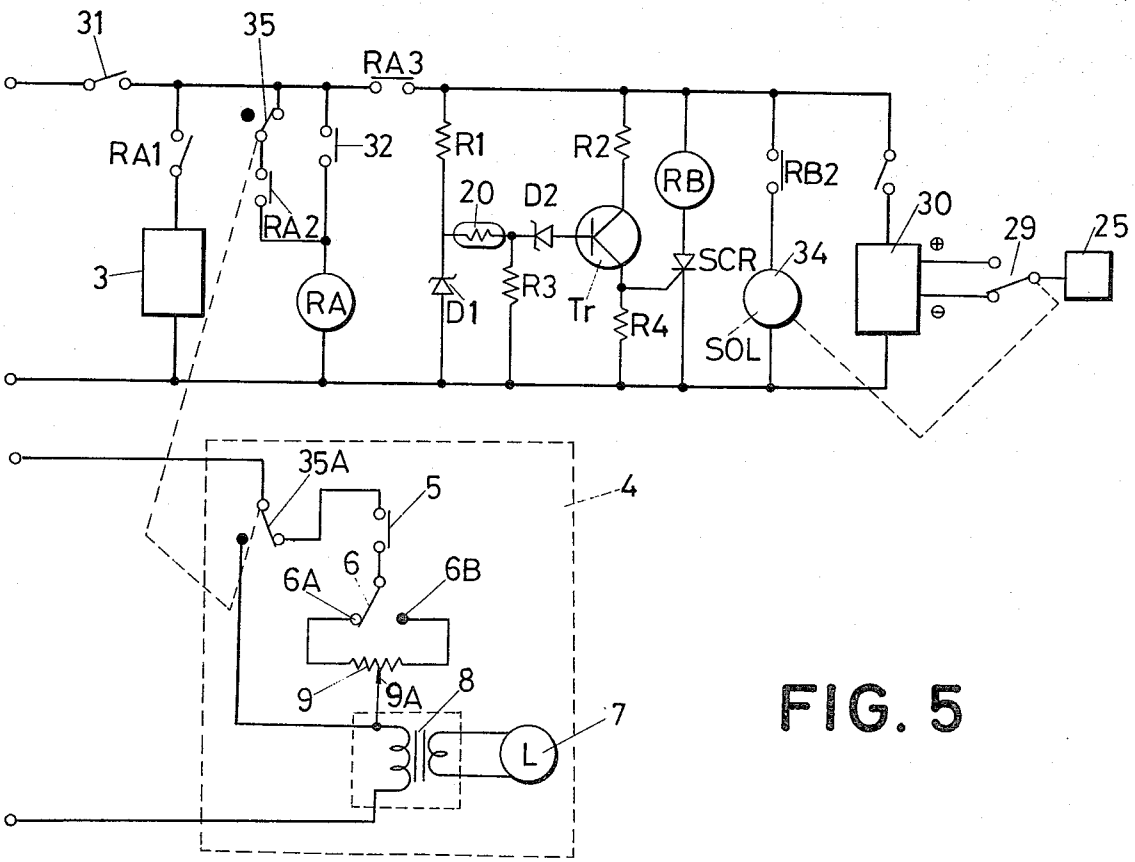
FIG. 5 is a circuit diagram of the electrical circuit used in the microreader-printer shown in FIG. 4.

The operation of the above apparatus will be described with reference to FIG. 5 which shows a circuit diagram. In FIG. 5, assuming an initial condition that a main switch 31 is closed alone, the reflecting mirror 18 remains in the position shown in solid line in FIG. 4, and the copying apparatus is in its inoperative condition, whereby the projection of the image of the microfilm 16 takes place onto the screen 19. When it is desired to obtain a copy, a print button 32 is depressed, whereby the reflecting mirror 18 is moved out of the path of projection light and the copying apparatus commences its operation. Specifically, a relay coil RA is energized and maintains its self-holding circuit by way of its contact RA2. Simultaneously, another contact RA1 associated with the relay coil RA activates the print drive circuit 3, and a further associated contact RA3 supplies power to the charging polarity switching circuit. In the charging polarity switching circuit, resistors R1, R2, R3, R4, Zener diode D1 for supplying a reduced voltage, photoelectric element 20, reference Zener diode D2, transistor Tr, output silicon controlled rectifier SCR and output relay RB form a detector for detecting the amount of light. The photoelectric element 20 has an incidence of light from the marginal region of the microfilm 16 thereon, and the amount of such light is reduced for a microfilm 16 of a positive type and is increased for a microfilm of a negative type, as mentioned previously. Assuming that the microfilm 16 is of a positive type, the amount of light incident on the light receiving element 20 is reduced, whereby it exhibits a resistance which is substantially greater than that of the reference resistor R3. Conversely, for a negative microfilm, the amount of incident light will be increased to make the resistance of the element 20 substantially less than that of the reference resistor R3.

As a consequence, for a positive microfilm 16, the voltage developed across the reference resistor R3 will be less than the voltage across the reference Zener diode D2, with a result that the transistor Tr is not operated; therefore, the relay coil RB is not energized through the SCR. A solenoid 34 which is connected across the power supply through the contact RB2 associated with the relay coil RB is not energized, so that the high tension switch 29 remains thrown to the negative side. Thus, under such condition, the charger 25 charges the light-sensitive paper to a negative polarity to permit developing with a toner having a positive polarity, thus producing a positive copy image. Such a relationship between the negative or positive nature of the image in the original film and the polarity of charging as well as toner favors a wet developing process. However, it should be understood that such relationship can be modified depending on the charging characteristic of the light-sensitive paper used.

When the microfilm 16 is of a negative type, the voltage developed across the reference resistor R3 will exceed the voltage across the reference Zener diode D2, with the consequence that the transistor Tr is rendered conductive to permit energization of the relay coil RB through SCR. Then the contact RB2 associated with the realy coil RB is closed to energize the solenoid 34, whereby the high tension switch 29 is thrown to the positive side, changing the polarity of the charger 25 to the positive polarity. In this instance, the charger 25 charges the light-sensitive paper to the positive polarity, and a toner of positive polarity is used to effect a so-called reversal development, thereby producing a positive copy image. It should be understood that the relationship in this instance again can be pre-established in any desired manner. Such a copying process is continued until a stop switch 35 is opened to break the self-holding circuit for the relay coil RA, thereby disconnecting the print drive circuit. While in the embodiment described above, the switching by way of detection of the film takes place at the time the print operation is initiated, the switching can be effected at any desired time, for example, when the original is set into the machine.

As shown in FIG. 5, the exposure controller circuit 4 according to the invention is associated with the electrical circuit of the microreader-printer described above. The circuit 4 includes a switch 35A which is adapted for interlocked operation with the stop switch 35 in the charging polarity switching circuit, and operates to connect the exposure controller circuit when the switch 35 is thrown to the charging side. In addition, the change-over switch 6 constitutes one of the relay contacts associated with the relay coil RB. When the relay coil RB is energized for a negative microfilm 16, the change-over switch 6 is thrown to the contact 6A as shown, but is connected to the contact 6B when the relay coil RB is not energized. In other respects, the exposure controller circuit is similar to that described previously in connection with FIG. 1.

From the foregoing, it will be appreciated that a determination whether the original carries a negative or a positive image is accomplished automatically, and the exposure controller circuit is also automatically changed based on such determination, thereby allowing the direction in which the dial of the controller should be operated to be maintained uniform without requiring a manual intervention of an operator.

It is to be understood that the invention is not limited to the features and advantages hereinabove specifically set forth but may be carried out in other ways without departure from its spirit.

What is claimed is:

1. Electrophotographic apparatus for producing, on a light-sensitive member, a positive toner image from either a positive or a negative original with toner of the same given polarity, including:

a. means for uniformly charging said light-sensitive member, including means for selecting the polarity to which the light-sensitive member is charged so that a positive toner image is obtained, with toner of said given polarity, for either a positive or negative original;

b. means, including an exposure lamp and controller therefor, for projecting an image of an original onto said light-sensitive member previously uniformly charged by said charging means, to form an electrostatic latent image on said member, said controller comprising means for adjusting the intensity of light emitted by said exposure lamp and having a first direction of adjustment and a second direction of adjustment;

c. means for developing the electrostatic latent image on said member with a toner of said given polarity; and d. a change-over switch, operatively connected to said controller for selectably reversing the effect of a given direction of adjustment of said controller on the intensity of light emitted by said exposure lamp depending on whether said original is a positive or negative original.

2. Electrophotographic apparatus according to claim 1, further including a photoelectric detector sensitive to a predetermined optical density in the marginal region of the original for discriminating between a negative and a positive image, and switching means responsive to a detection signal from the detector for switching the polarity of said charging means, said switching means being interlocked with said change-over switch.

3. Electrophotographic apparatus according to claim 2, in which the photoelectric detector discriminates between a negative and a positive image by sensing the amount of light transmitted through a marginal region of the original.

4. Electrophotographic apparatus for developing, by application of toner of given polarity to a surface bearing an electrostatic latent image of an original, a positive toner image of either a positive or a negative original, said apparatus comprising:

a. means for uniformly charging a photoconductive surface, including means for reversing the polarity to which the surface is charged depending on whether the original is positive or negative;

b. means including a light source for exposing the uniformly charged photoconductive surface to an optical image of an original, thereby to establish on the surface an electrostatic latent image of the original;

c. means for developing the electrostatic latent image to produce a toner image with toner of said given polarity;

d. adjustable means for varying the intensity of light emitted by said light source to vary the density of the ultimately produced toner image, said adjustable means having a first direction of adjustment and a second direction of adjustment; and e. a change-over switch, operatively connected to said adjustable means for reversing the effect of a given direction of adjustment of said adjustable means on the intensity of light emitted by said light source depending on whether the original is positive or negative.

5. Apparatus as defined in claim 4, wherein said exposing means includes an electrical power supply for said light source; wherein said adjustable means comprises means for varying the effective voltage of said power supply and includes a bidirectionally movable adjusting element for varying said voltage; and wherein said switch is operable between a first position in which movement of said element in a given direction increases said voltage, and a second position in which movement of said element in the same direction decreases said voltage.

6. Apparatus as defined in claim 4, for use with an original having a marginal portion of optical density representative of the positive or negative character of the original, wherein said polarity-reversing means comprises second switch means for selecting the polarity to which a photoconductive surface is charged by said charging means, and photoelectric means for detecting the optical density of said marginal portion of an original and actuating said second switch means in response thereto.

7. Apparatus as defined in claim 6, wherein said polarity-reversing means includes means for actuating said first-mentioned switch together with said second switch means in response to the detected optical density of said marginal portion of the original.

8. Apparatus as defined in claim 4, including photoelectric means for sensing the optical density of a preselected marginal portion of an original as representative of the positive or negative character of the original, and means actuated by said photoelectric means for operating said switch in response to the sensed positive or negative character of the original.

* * * * *